United States Patent [19]

Cabarroca's Pruneda

[11] Patent Number: 4,751,903

[45] Date of Patent: Jun. 21, 1988

[54] FUEL PUMPING APPARATUS

[75] Inventor: D. Domingo Cabarroca's Pruneda, Barcelona, Spain

[73] Assignee: Lucas Industries Public Limited Company, Birmingham, United Kingdom

[21] Appl. No.: 11,765

[22] Filed: Feb. 3, 1987

[30] Foreign Application Priority Data

Feb. 24, 1986 [ES] Spain ..... 552311

[51] Int. Cl.[4] ..... F02M 29/00

[52] U.S. Cl. ..... 123/450; 123/373; 123/387; 417/462

[58] Field of Search ..... 123/373, 450, 500, 501, 123/387; 417/462

[56] References Cited

U.S. PATENT DOCUMENTS

| | | | |
|---|---|---|---|
| 4,406,264 | 9/1983 | Mowbray | 417/462 |
| 4,441,474 | 4/1984 | Jarrett | 417/462 |
| 4,473,048 | 9/1984 | LeBlanc | 123/450 |
| 4,499,883 | 2/1985 | Miyaki | 123/450 |
| 4,587,940 | 5/1986 | Schmid | 123/500 |
| 4,662,337 | 5/1987 | Eheim | 123/357 |

*Primary Examiner*—Carl Stuart Miller

*Attorney, Agent, or Firm*—Balogh, Osann, Kramer, Dvorak, Genova & Traub

[57] ABSTRACT

A fuel pumping apparatus of the rotary distributor type has a spill control sleeve mounted on the distributor member. The sleeve is axially movable to vary the quantity of fuel delivered by the apparatus and in addition the distributor member is also axially movable by means of a pressure responsive piston, the pressure applied to which varies in accordance with the speed of the associated engine.

5 Claims, 13 Drawing Sheets

FUEL PUMPING APPARATUS

Figure 1:
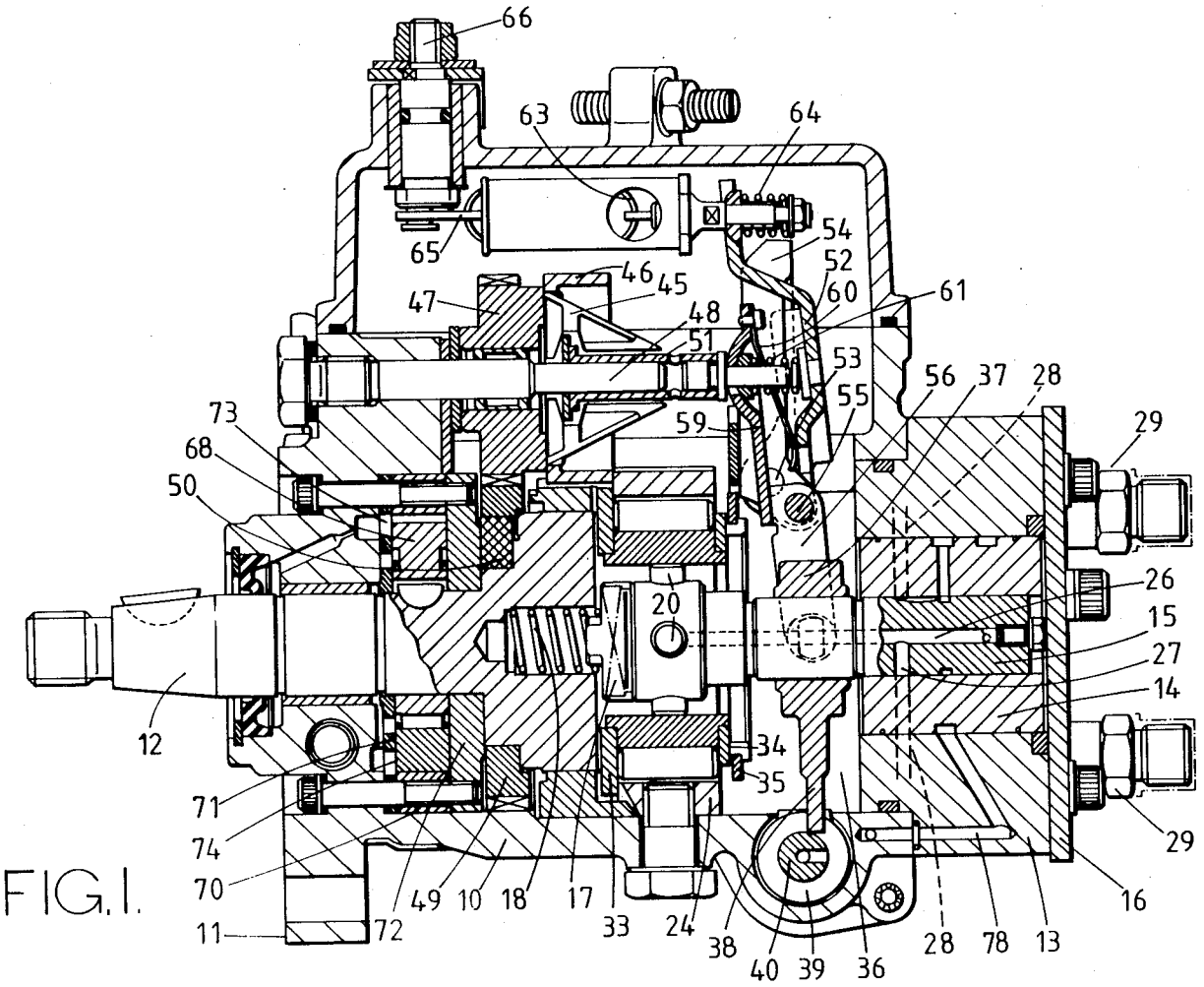
Figure 2:
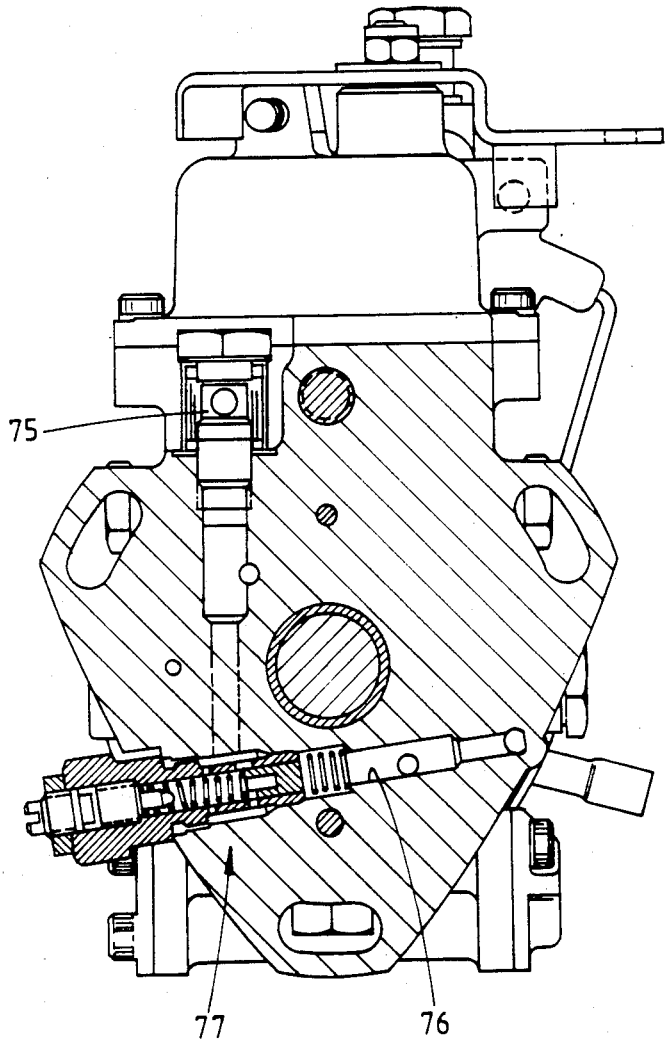

This invention relates to a fuel pumping apparatus for supplying fuel to an internal combustion engine and of the kind comprising a housing, a rotary distributor member mounted in the housing, a transverse bore in the distributor member, a pumping plunger in the bore, a cam ring surrounding the distributor member and defining a plurality of inwardly extending cam lobes which impart inward movements to the plunger as the distributor member rotates, passage means in the distributor member communicating with the bore, said passage means being arranged to communicate in turn with a plurality of outlets in the housing during successive inward movements of the plunger, means for supplying fuel to the bore to effect outward movement of the plunger in the periods between successive inward movements of the plunger, an axially movable sleeve located about the distributor member the sleeve and distributor member defining spill path means whereby fuel can be spilled from said bore during the inward movement of the plunger, the relative axial position of the distributor member and sleeve determining the amount of fuel which is supplied through the outlets and governor means for controlling the axial setting of the sleeve within the housing.

When the engine associated with the apparatus is powering a vehicle, it is the practice to provide what is known in the art as "torque control". This can be achieved within the governor mechanism and it comprises some way of varying at least the maximum amount of fuel which can be supplied to the engine in accordance with the engine speed. When the governor mechanism is of a mechanical type this is not always easy and an object of the invention is to provide an apparatus of the kind specified in a form in which variation of the amount of fuel supplied to the engine in accordance with the engine speed can be readily achieved.

A further problem can arise with an apparatus of the kind specified when the apparatus is arranged to supply fuel to an engine having say more than four cylinders and when the sleeve is movable angularly about the axis of rotation of the distributor member to allow variation of the commencement of fuel delivery. In an extreme angular position of the sleeve it is possible for the spill path means to be opened while fuel is being supplied to the bore to effect outward movement of the plunger and in this situation the plunger may not be moved outwardly its maximum amount.

According to one aspect of the invention in an apparatus of the kind specified said distributor member is axially movable within the housing, the apparatus including resilient means biasing the distributor member in one axial direction, means for generating a fluid pressure which varies in accordance with the speed at which the apparatus is driven, a piston movable by said fluid pressure against the action of a spring, a profile defined on said piston and means engaging said profile and said distributor member whereby movement of said piston will result in axial movement of the distributor member and variation of the amount of fuel supplied by the apparatus.

According to another aspect of the invention in an apparatus of the kind specified said spill path means includes a non-return valve which is set to open at a pressure which is greater than the pressure of fuel supplied to the bore during the outward movement of the plunger but less than the pressure of fuel in the bore during inward movement of the plunger.

Figure 4:
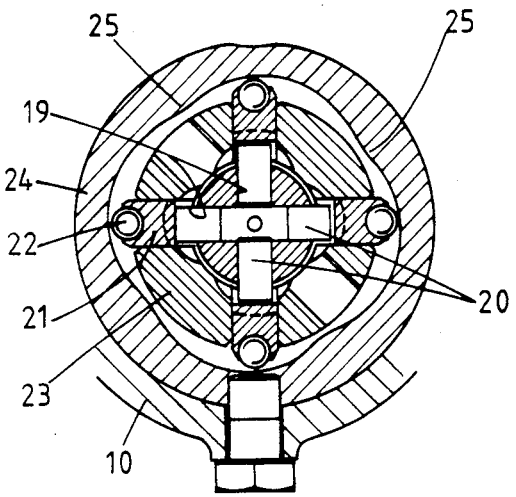
Figure 5:
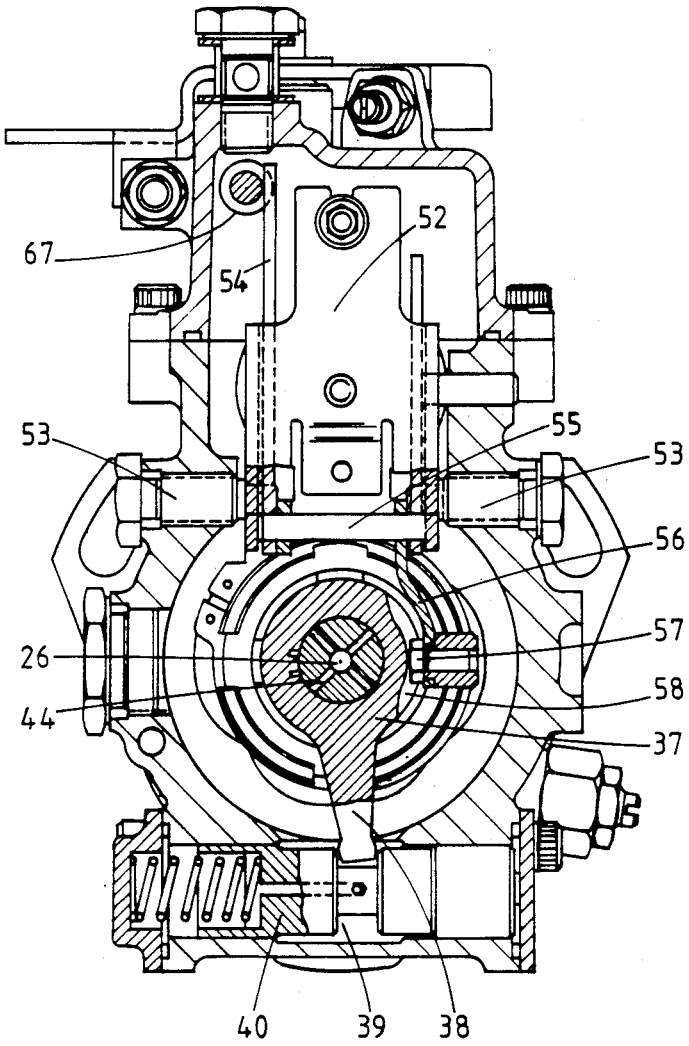
Figure 6:
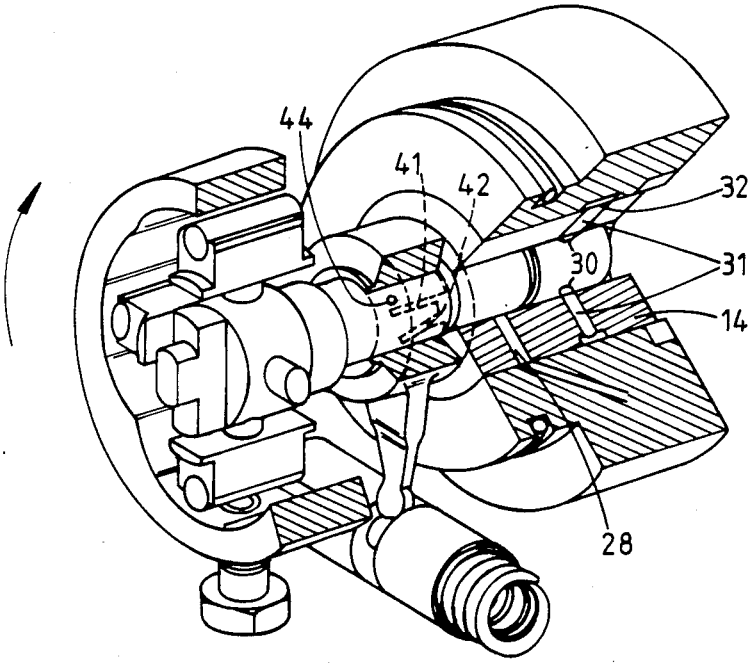
Figure 7:
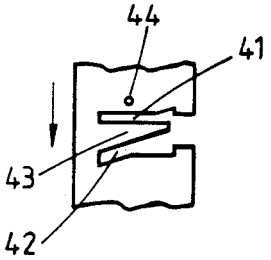
Figure 8:
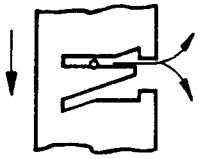
Figure 12:
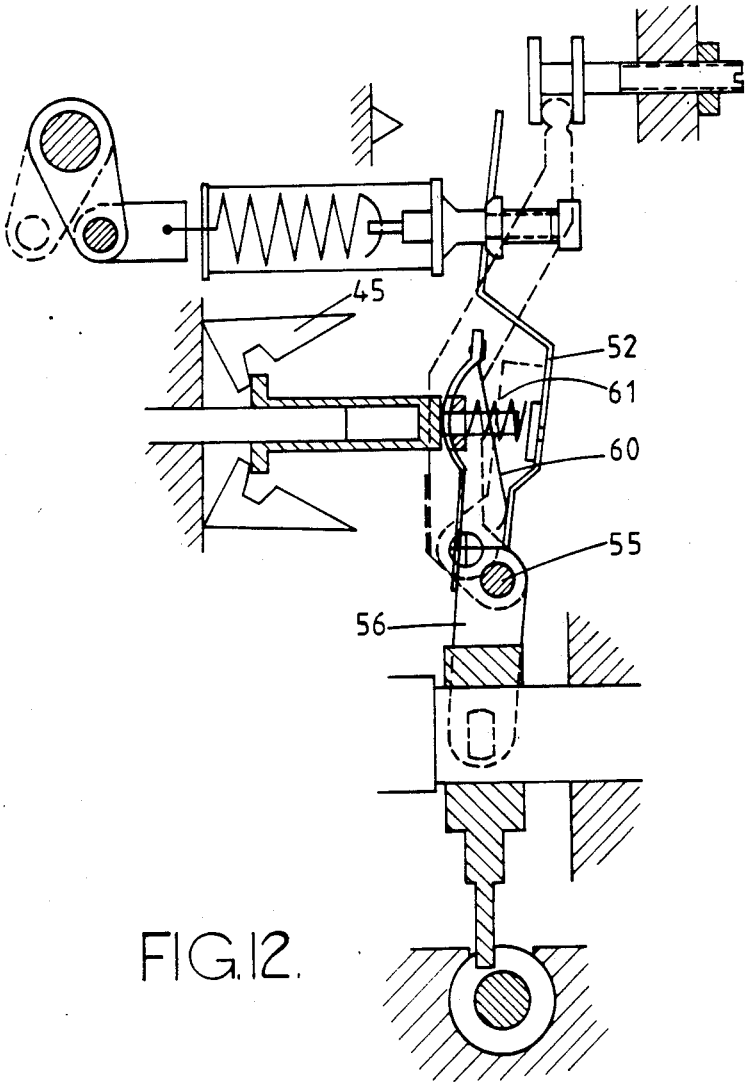
Figure 13:
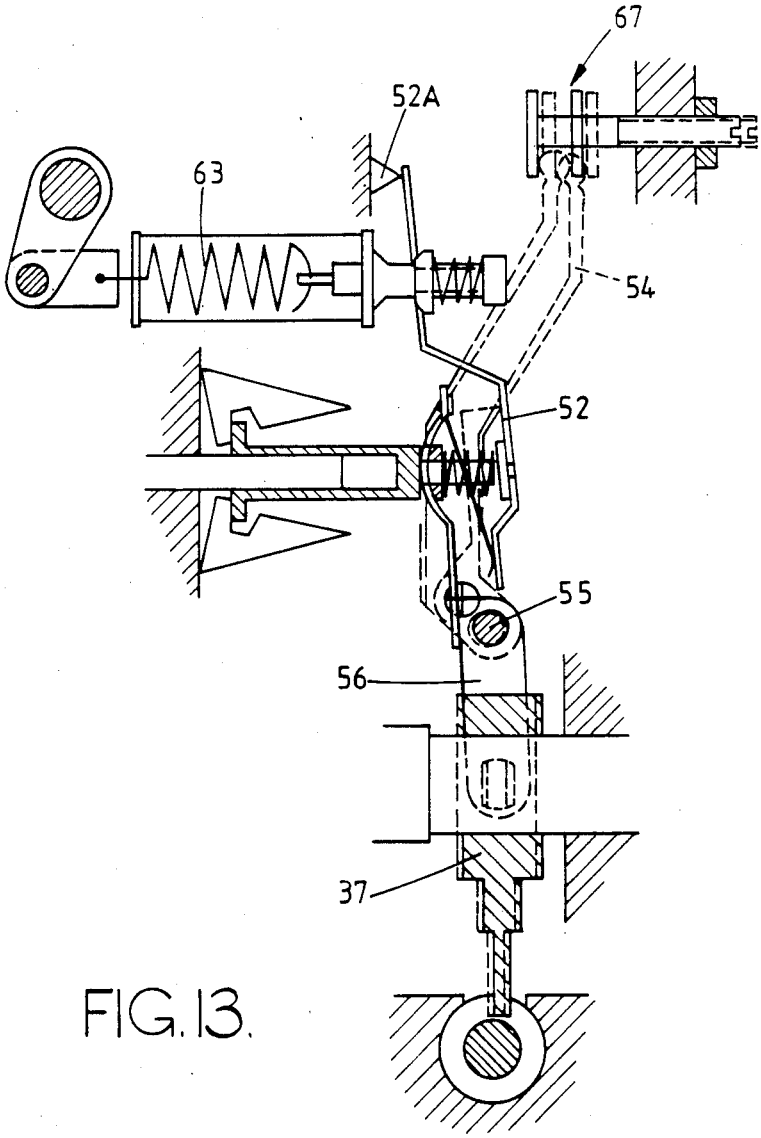
Figure 14:
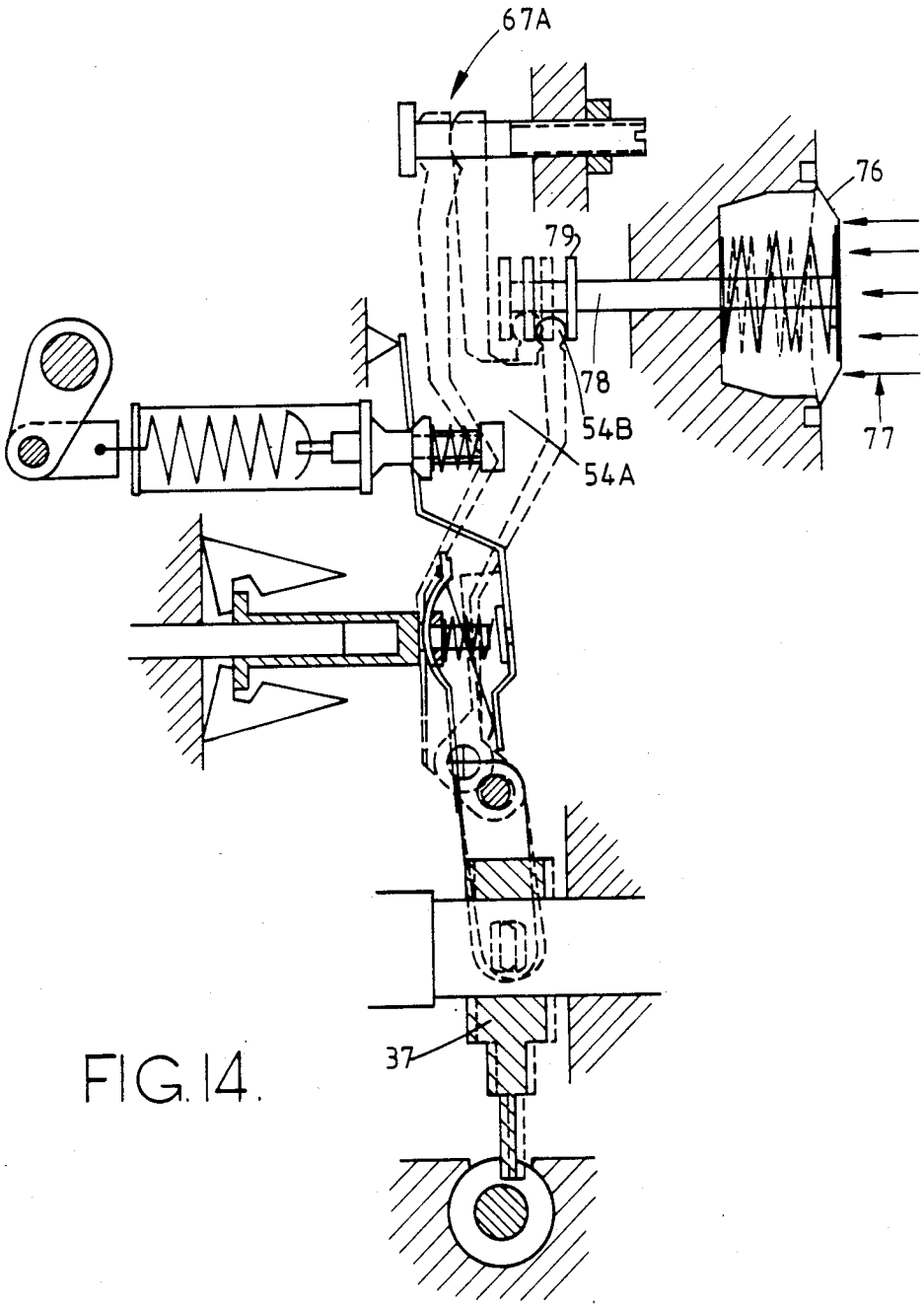
Figure 15:
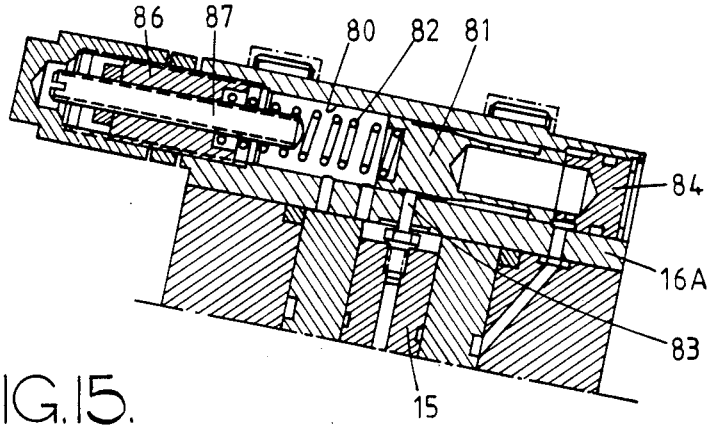
Figure 16:
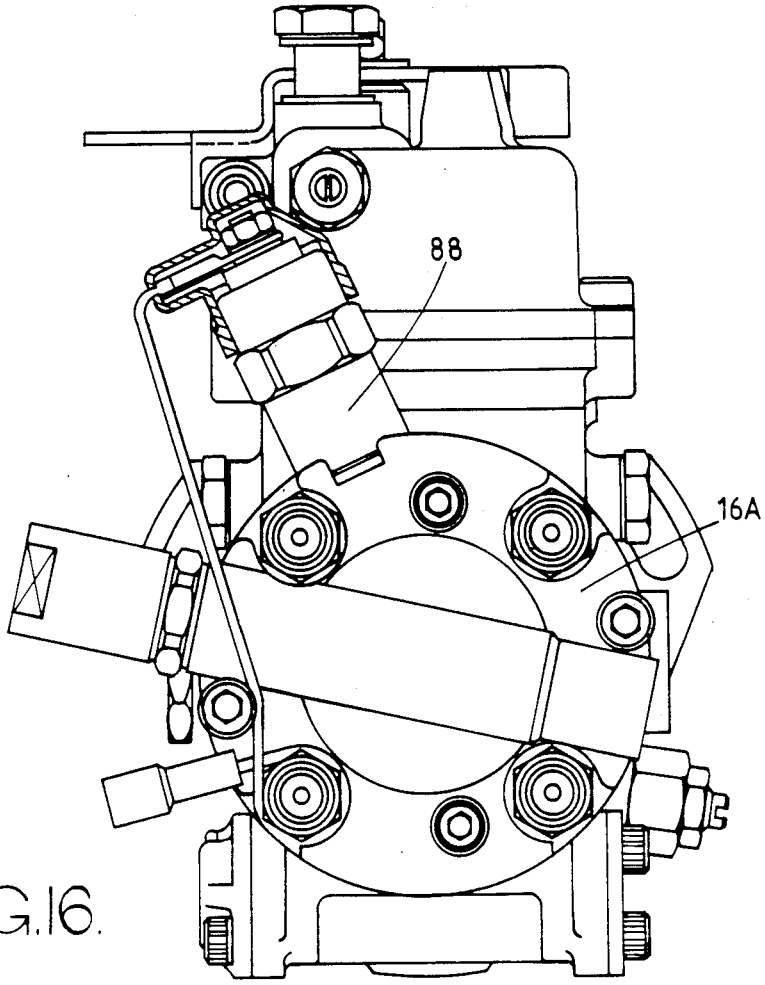
Figure 17:
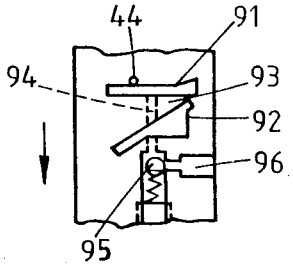
Figure 18:
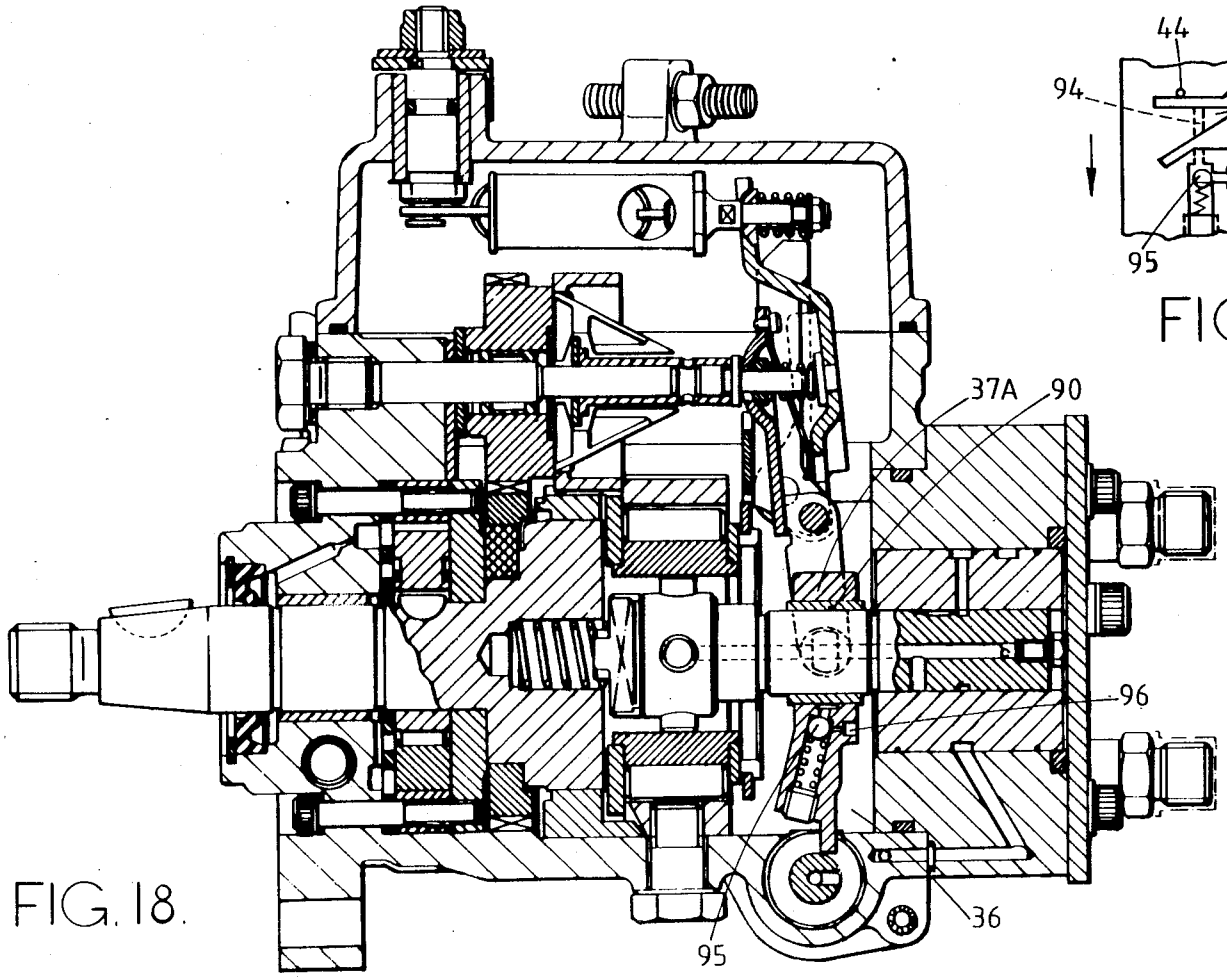
Figure 19:
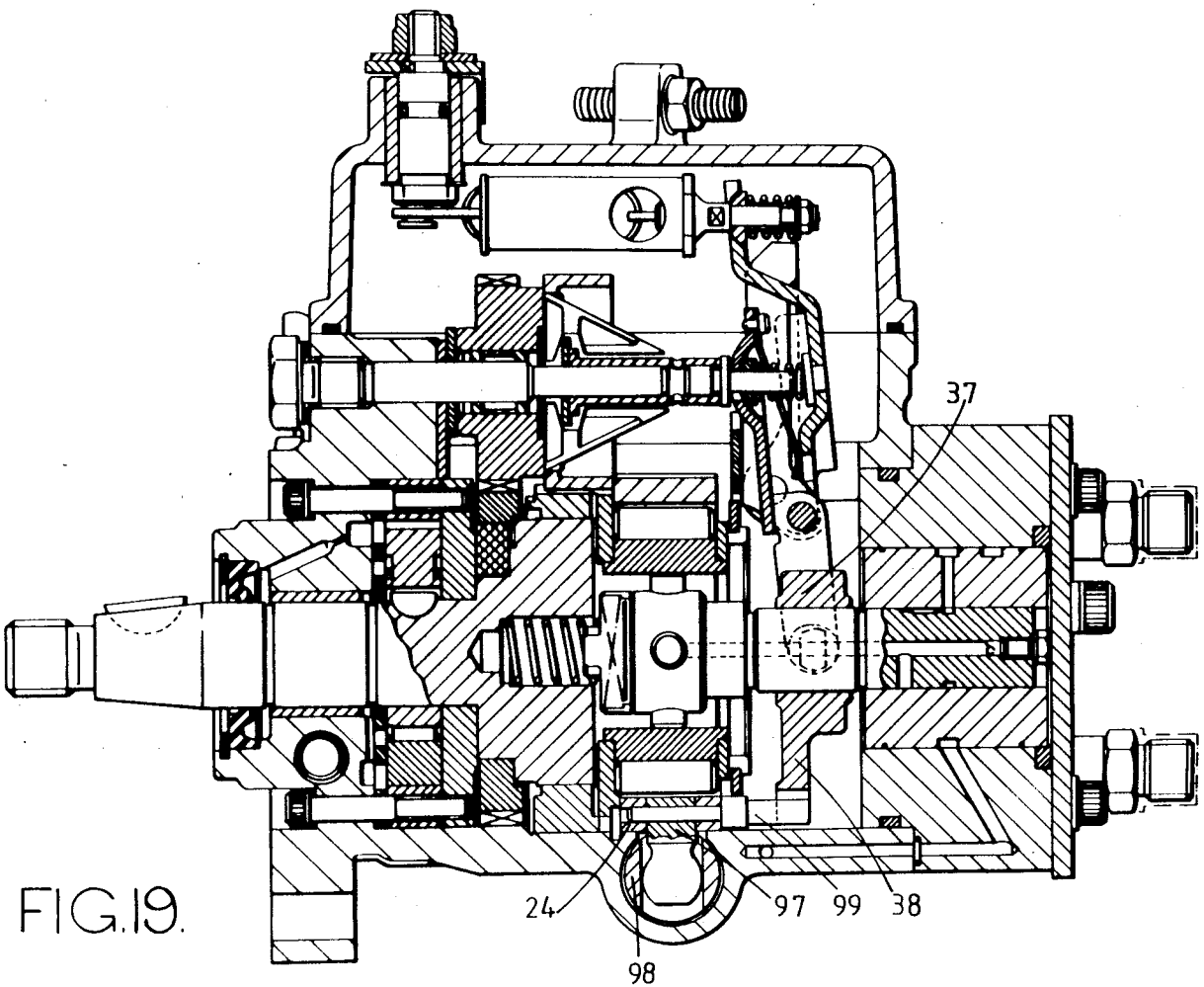
Figure 20:
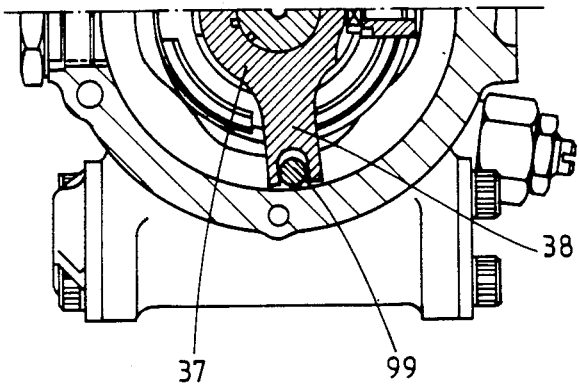
Figure 21:
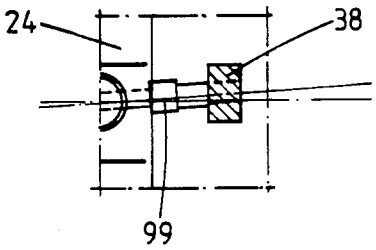

In the accompanying drawings:

FIG. 1 is a sectional side elevation of an example of a fuel pumping apparatus to which the inventions may be applied, FIGS. 2, 3, 4 and 5 are sectioned through parts of the apparatus seen in FIG. 1, FIG. 6 is a perspective view of parts of the apparatus of FIG. 1 with portions thereof broken away for the sake of clarity, FIGS. 7, 8, 9 and 10 are diagrams illustrating the operation of the spill means of the apparatus of FIG. 1, FIGS. 11, 12 and 13 show to an enlarged scale part of the apparatus of FIG. 1 in different settings, FIG. 14 shows a modification to the part of the apparatus seen in FIGS. 11–13, FIG. 15 shows a modification in accordance with the first aspect of the invention to the apparatus shown in FIG. 1, FIG. 16 shows an end view of the apparatus incorporating the modification of FIG. 15, FIG. 17 is a diagram similar to FIG. 7 of the modification, FIG. 18 is a view similar to FIG. 1 showing a modification in accordance with the second aspect of the invention, FIG. 19 is a view similar to FIG. 1 showing a further modification to the apparatus of FIG. 1, FIG. 20 is an end view of part of the modification of FIG. 19, and FIG. 21 shows a variation of the modification seen in FIG. 19.

With reference to FIG. 1 of the drawings the apparatus includes a hollow housing part 10 which is provided with a flange 11 whereby it can be mounted on the casing of the associated engine. Extending into the housing part 10 is a drive shaft 12 which is coupled in use to a rotary part of the engine so as to be driven in synchronism with the engine. Facing the drive shaft the housing part 10 is provided with an opening which is closed by a second housing part 13 in which is located a fixed sleeve 14 within which is journalled a rotary distributor member 15. The open end of the sleeve is closed by a thrust plate 16 secured to the housing part 13. The distributor member is coupled to the drive shaft 12 by means of a dog and slot connection 17 and the distributor member is biased into contact with the thrust plate by means of a spring 18 housed within the drive shaft.

Formed in the distributor member 15 is a pair of radial bores 19 (FIG. 4) in each of which is mounted a pair of pumping plungers 20. At their outer ends the plungers are engaged by cam followers respectively each cam follower including a shoe 21 which carries a roller 22. The shoes as seen in FIG. 4 are mounted in slots formed in an enlarged portion 23 of the drive shaft which surrounds the distributor member. The rollers 22 can engage with the internal peripheral surface of an annular cam ring 24 which in the example shown in FIG. 1 is secured within the housing part 10. The cam ring is provided with a plurality of pairs of cam lobes 25 which engage the rollers as the distributor member is rotated to impart inward movements to the cam followers and the plungers. In the example there are two pairs of cam lobes and the apparatus is intended to supply fuel to a four cylinder engine.

The cam followers are located against axial movement by a pair of side plates 33, 34, disposed on opposite sides of the cam followers, the plate 34 being located by a spring clip 35 and the plate 33 being located by the cam ring 24. The plate 33 also serves to provide axial location for the drive shaft 12. The side plates can be engaged by lateral projections on the shoes 21 to limit the extent of outward movement of the shoes and plungers.

Extending within the distributor member 15 is an axial passage 26 which at its end remote from the plungers is plugged and which at its other end opens into the bores 19. At one point the passage 26 communicates with a delivery passage 27 which is positioned to register in turn with outlet ports 28 formed in the sleeve 14 and the housing part 13 during successive inward movements of the pumping plungers. The ports 28 connect with outlet unions 29 respectively which in use are connected to the injection nozzles respectively of the associated engine. At another point the axial passage 26 communicates with a pair of inlet passages 30 (FIG. 6), formed in the distributor member and opening to the periphery thereof. The inlet passages 30 are arranged to communicate with inlet ports 31 formed in the sleeve 14, during the time the plungers are allowed to move outwardly by the cam lobes. The ports 31 open at their outer ends into a circumferential groove 32 which is in communication with the outlet of a low pressure pump to be described.

The housing parts 10 and 13 define a cavity 36 through which the distributor member extends and slidable on the portion of the distributor member in the cavity is a sleeve 37 from which extends an arm 38. The end of the arm is located within a circumferential groove 39 formed in the periphery of a spring loaded piston 40 which is housed within a cylinder.

The sleeve 37 on its internal peripheral surface defines a pair of grooves 41, 42 which are shown in dotted outline in FIG. 6. The grooves at one end being open to the cavity 36 and extending part way across the surface of the sleeve. In the example the groove 41 extends axially whereas the groove 42 is inclined. The grooves define between them a wedge shaped land 43 the task of which is to cover one of four equally spaced ports 44 which are formed in the distributor member and which open into the axial passage 26. Clearly the number of degrees of rotation of the distributor member during which the one port 44 is covered by the land (the remaining ports 44 being covered by the internal surface of the sleeve) depends upon the axial position of the sleeve and the instant at which the port is covered by the leading axially extending edge of the land depends upon the angular setting of the sleeve, this being determined by the position of the piston 40.

The axial setting of the sleeve 37 is determined by a governor mechanism and this comprises a plurality of governor weights 45 which are housed in a cage 46 secured to a gear wheel 47 mounted about a support shaft 48 secured in the housing part 10. The gear wheel 47 is driven by a ring gear 49 which is mounted on the drive shaft 12 and conveniently shock absorbing inserts 50 are employed. The shaft 48 carries an axially movable flanged sleeve 51, the flange of which is engaged by the weights 45 whereby as the weights move outwardly, axial movement will be imparted to the sleeve 51. The governor mechanism includes a first lever 52 which has a central web and side flanges and is pivotally supported in the housing part 10 by means of a pair of screws 53. Also provided is a second lever 54 which is also supported for pivotal movement on the screws 53 and which carries a pin 55 the axis of which is offset from that of the screws. The pin 55 carries a third lever 56 having an arm which extends downwardly and around the sleeve 37 and is provided with a pin 57 (FIG. 5) which locates in a groove 58 formed in the sleeve 37. The pin 57 and groove 58 allow angular movement of the sleeve 37 under the action of the piston 40, while at the same time pivotal movement of the lever 56 about the pin 55 will cause axial movement of the sleeve 37.

The lever 56 has an upwardly extending arm 59 which has a dished portion in which is formed an aperture through which the end portion of the shaft 48 extends. The sleeve 51 is engaged with the dished portion of the arm 59. Mounted on the end portion of the arm 59 is a leaf spring 60 the free end of which extends towards the pin 55 and is curved for engagement with the first lever 52. Moreover, interposed between the arm 59 and the lever 52 is a light coiled compression spring 61. The end of the lever 52 remote from the pin 56 is connected to one end of a preloaded tension spring 63 through the intermediary of a preloaded compression spring 64 and the other end of the spring 63 is connected to an arm 65 carried by a shaft 66 extending to the exterior of the apparatus and connected in use to the throttle pedal of the vehicle with which the apparatus is associated.

The second lever 54 as seen in FIG. 5 is engaged in a collar 67 which is adjustably mounted in a cover for the housing part 10 whereby the position of pin 55 can be adjusted.

Figure 3:
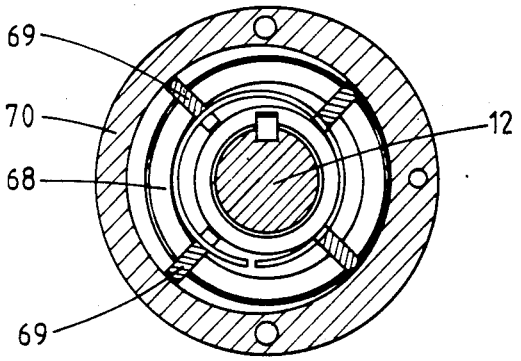

Fuel is supplied to the bores containing the plungers 20 and to the cylinder containing the piston 40 by a low pressure fuel pump the rotor 68 of which is mounted about and keyed to the drive shaft 12. As shown in FIG. 3, the rotor carries four vanes 69 which are spring biased outwardly into engagement with the inner surface of a ring 70 which is secured within the housing part 10 and the inner surface is eccentrically disposed relative to the axis of the distributor member. The ring 70 is sandwiched between a port plate 71 and an end plate 72, the latter serving as an end thrust plate for the drive shaft. The port plate includes an inlet port 73 and an outlet port 74, the former being connected to a fuel inlet 75 on the exterior of the housing and the latter being connected to a transverse drilling 76 (FIG. 2) which contains a pressure control valve 77 of conventional design and which operates to ensure that the outlet pressure of the low pressure pump varies in accordance with the speed at which the apparatus is driven. From the drilling 76 the fuel is supplied to the groove 32 and from the groove 32 by way of a passage 78 to the cylinder containing the piston 40.

Figure 9:
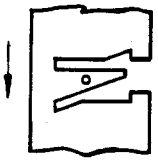
Figure 10:
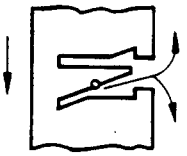

The operation of the apparatus will now be described ignoring for the moment the governor mechanism. As shown in FIG. 6 the distributor member is at a position such that the passages 30 are in register with the inlet ports 31 so that fuel from the low pressure pump has filled the bore 19 and the plungers have been moved out their maximum extent as determined by the side plates 33, 34, It should be noted that the delivery passage 27 is out of register with the outlets 28 and also that the ports 44 as seen in FIG. 7, are covered by the sleeve 37. As the distributor member rotates, the ports and passages 31, 30 will move out of register and the passage 27 will move into register with an outlet 28. At the same time a port 44 will be opened to the groove 43 (FIG. 8) and the plungers will start their inward movement. The fuel displaced by the plungers will flow through the port 44 and groove 41 until the port 44 is covered by the leading edge of the land 43. When this occurs as shown in FIG. 9, the flow of fuel through the port 44 will cease and fuel will flow through the delivery passage 27 and the outlet 28 in communication therewith. The flow of fuel will continue until the port 44 is uncovered (FIG. 10) by the trailing and inclined edge of the land whereafter the remaining quantity of fuel displaced by the plungers will flow through the port 44 to the cavity 36.

If the sleeve 37 is moved towards the plungers the port 44 will be covered for a shorter time in terms of degrees of rotation of the distributor member and therefore the amount of fuel supplied to the engine will be reduced and vice versa. If the sleeve 37 is moved in the direction of the arrow in FIG. 6 the timing of the start of fuel delivery will be retarded and vice versa. Since the angular position of the sleeve is determined by the piston an increase in the outlet pressure of the low pressure pump, as occurs with an increase in the engine speed, will result in advancement of the start of fuel delivery to the engine.

Figure 11:
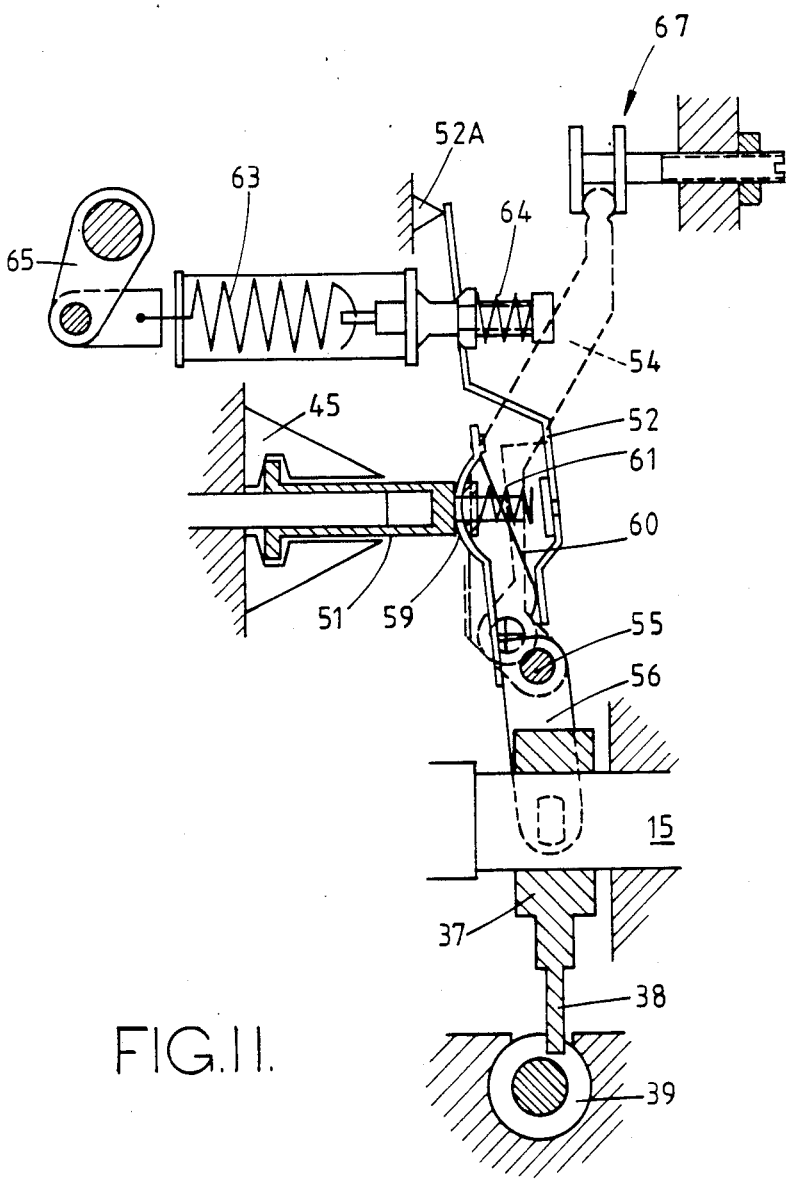

Considering now the operation of the governor mechanism and with reference to FIGS. 11–13 which show the mechanism to an enlarged scale and in different operational positions. In FIG. 11 the parts of the mechanism are shown in the positions which they are caused to adopt when trying to start the engine. It will be noted that the lever 65 has been moved by depression of the throttle pedal of the vehicle to move the lever 52 into contact with a stop 52A. The lever 56 under the action of the leaf spring 60 has rotated about the pin 55 to urge the weights inwardly their maximum extent and to move the sleeve 37 to a position in which an excess quantity of fuel will be supplied to the engine for starting purposes. It should be noted that the spring 61 is clear of the lever 52. When the associated engine starts and the throttle is released, the parts of the mechanism will assume the position shown in FIG. 12. It will be seen that the weights have opened out under the action of centrifugal force thus pivoting the lever 56 about the pin 55 and compressing the leaf spring 60 to the extent that the spring 61 is brought into operation. In particular it will be noted that the sleeve 37 has moved to a position in which the amount of fuel supplied to the engine is sufficient for engine idling. In the event of an increase in the speed of the engine above the desired idling speed the weights will move out further and the lever 56 will pivot against the action of the springs 60 and 61 to reduce the amount of fuel supplied to the engine and hence the engine speed and vice versa. FIG. 13 shows the situation when the throttle pedal is fully depressed. The lever 52 has been moved once again into contact with the stop 52A and has caused the lever 56 to pivot about the pin 55 to move the sleeve 37 to increase the amount of fuel supplied to the engine to its maximum allowed value. In addition the weights have been forced inwardly. This situation will prevail until the centrifugal force acting on the weights is sufficient to cause the weights to move outwardly against the action of the preloaded spring 63 and when this occurs the lever will pivot to move the sleeve 37 to reduce the amount of fuel supplied to the engine thereby to limit the engine speed to a safe maximum value. The governor mechanism as described therefore is of the so called "two speed" type in which the engine idling speed and its maximum speed are controlled. Intermediate these speeds the setting of the sleeve 37 and hence the amount of fuel supplied to the engine depends on the setting of the throttle pedal.

FIG. 13 also shows the stop 67 which determines the position of the lever 54 and the setting of the pin 55. If the stop is adjusted so as to cause the lever 54 to move in the anticlockwise direction about the axis of the screws 53, the sleeve will move in a direction to increase the amount of fuel supplied and vice versa. The stop 67 therefore enables the maximum amount of fuel which can be supplied to the engine in the normal operation of the engine, to be adjusted.

FIG. 14 shows a modification which is intended for use with an engine which is provided with a turbo-supercharger. The lever 54A is a modified version of the lever 54 and the position of the lever depends upon the pressure of air applied to a spring loaded diaphragm 76, the air pressure being depicted by the arrows 77. The diaphragm is connected to a rod 78 upon which is mounted a grooved bush 79. The lever 54A is provided with a projection 54B which locates in the groove in the bush and the arrangement is such that as the air pressure increases the lever 54A will be moved in a direction to cause movement of the sleeve 37 in the direction to increase the amount of fuel supplied to the associated engine. The stop 67A is in this case a simple stop which limits the extent of movement of the lever 54A under the action of the diaphragm and it therefore determines the maximum amount of fuel which can be supplied to the engine when the turbo supercharger is in operation, the springs which bias the diaphragm acting to position the rod 78 at a predetermined and adjustable position so as to limit the maximum amount of fuel which can be supplied to the engine when the turbo supercharger is not generating sufficient pressure to operate the diaphragm.

It will be noted that the arm 38 during movement of the sleeve 37 by the governor mechanism is free to move in the groove 39 in the piston 40 and by virtue of the groove 58 on the sleeve 37 movement of the piston can effect angular movement of the sleeve to vary the timing of fuel delivery, independently of the governor mechanism.

FIGS. 15 and 16 illustrate a modification to the apparatus described, the modification being for the purpose of providing what is known in the art as "torque control". As described the process of limiting the engine speed by the governor mechanism takes place suddenly. This is because the spring 63 will yield when its preload force is attained and this will permit the weights 45 to move outwardly so that the force generated by the weights will increase thereby resulting in further extension of the spring and a further increase in the force generated by the weights and so on. The sleeve 37 will therefore be moved very quickly to reduce the fuel. The effect therefore is that the torque produced by the engine suddenly falls and is restored almost as quickly as the engine speed falls. In order to avoid this undesirable effect, "torque control" is provided which has the effect of reducing the amount of fuel supplied to the engine as the engine speed increases and particularly as the maximum governed speed of the engine is approached. The provision of "torque control" in the sense of reducing the fuel with increasing speed, is achieved by allowing the distributor member 15 to move towards the right as seen in FIG. 1 which has the same practical effect so far as fuel delivery is concerned, as moving the sleeve 32 towards the left.

As shown in FIG. 15 the thrust plate 16 is replaced by a thrust plate 16A which defines a cylinder 80 in which is located a piston 81 which is biased by a coiled compression spring 82. The longitudinal axis of the piston is disposed at right angles to the axis of rotation of the distributor member. The thrust plate is provided with an opening which is aligned with the axis of the distributor member and in which is located a pin 83 which at one end engages the distributor member and at the other end engages with the piston 81. The intermediate portion of the piston surface defines a profile so that as the piston moves against the action of the spring 82 the distributor member under the action of the spring 18 will move towards the right. The cylinder at its end remote from the spring is closed by a plug 84 and fuel is admitted to a chamber defined by the plug from the outlet of the low pressure pump. The portion of the cylinder 80 containing the spring is vented and this end of the cylinder is closed by a plug 86 which carries an adjustable abutment for the spring 82. By adjustment of the force exerted by the spring the speed at which the piston starts to move can be varied and the extent of movement of the piston can be controlled by means of an adjustable stop 87. It will be understood that the reduction of the fuel quantity with increasing speed takes place whatever the setting of the lever 65.

FIG. 16 shows an end view of the apparatus with the plate 16A and the enlarged portion thereof within which the cylinder 80 is formed. Also illustrated in this figure is the housing of an electromagnetically operable valve 88 which is energised to allow fuel flow from the low pressure pump to the groove 32 and which is de-energised to prevent flow of fuel when it is required to stop the associated engine.

In the case of an apparatus intended to supply fuel to an engine having more than four cylinders for example a six cylinder engine the spacing between the ports 44 is reduced as also is the spacing between the inlet ports 30 and the inlet passages 31. In addition of course there will be an appropriate adjustment of the number of cam lobes 25 on the cam ring 24 and an adjustment in the disposition of the plungers and possibly their number. If the rate of fuel delivery is to remain the same as for the four cylinder engine the leading flanks of the cam lobes and the disposition and sizes of the grooves 41 and 42 must remain the same as also will the diameters of the various ports and passages. The space required for the two extra cam lobes must therefore be taken from the trailing flanks of the cam lobes and the space or gap between the trailing flank of one cam lobe and the leading flank of the next cam lobe. The effect of course is that there is less time to fill the bores 19 containing the plungers 20 with fuel. In an extreme angular position of the sleeve 37 when the latter has been set to provide maximum advance of the timing of fuel delivery, it is possible for a port 44 to be brought into register with the groove 41 before the inlet ports 31 and inlet passages 30 have moved out of register. As a result the fuel pressure in the passage 26 in the distributor member may fall so that the plungers 20 do not reach the limit of their travel or if they are at the limit of their travel, they may move inwardly. In each case this may mean that the plungers are not being driven inwardly by the cam lobes at the instant when the port 44 is covered by the leading edge of the land 43. As a result the timing of the commencement of fuel delivery will be later than that dictated by the the angular setting of the sleeve 37 and in addition, the quantity of fuel supplied will be reduced.

The aforesaid problem is overcome by modifying the apparatus as shown in FIGS. 17 and 18. In the example the sleeve 37A is modified by the provision of an inner sleeve 90 in which is formed slits 91, 92 arranged in the same manner as the grooves 41, 42 so as to define a wedge shaped land 93. In this case the slits do not extend to the edge of the sleeve but they communicate with a groove 94 formed in the inner surface of the sleeve 37A, the groove 94 communicating with the space 36, by way of a non return valve 95 which controls flow of fuel through a spill passage 96. The valve 95 is set to open at a pressure which is higher than the pressure developed by the low pressure pump but lower than the pressure which is developed during fuel delivery to the associated engine. If therefore a port 44 is exposed to the slit 91 during the filling phase no fuel will flow from the port 44 to the slit and therefore the plungers will move outwardly their maximum extent. When the port 44 is opened to the slit 92 to terminate fuel delivery the valve 95 is opened by the pressure developed by the inward movement of the plungers.

In the arrangements so far described the adjustment of the start of delivery of fuel is effected by adjustment of the angular setting of the sleeve 37. With this arrangement therefore the start of delivery of fuel can take place at different points on the leading flanks of the cam lobes. In order to ensure that the start of delivery of fuel takes place at the same points on the leading flanks of the cam lobes irrespective of the timing of fuel delivery it is proposed to adjust the angular setting of the cam ring 24 in synchronism with the sleeve 37. FIG. 19 therefore shows the cam ring 24 coupled by means of a radial peg 97 to a piston 98 the piston 98 being spring loaded and exposed to the outlet pressure of the low pressure pump in the same manner as the piston 40. The latter piston is no longer required its duty being taken over by a peg 99 secured to the cam ring and which is located in a slot formed in the end of the lever 38. If the peg 99 is disposed parallel to the axis of the distributor member no variation in timing will occur as the axial position of the sleeve is varied. However, if the peg 99 is inclined as shown in FIG. 21 then as the sleeve 37 is moved axially to vary the quantity of fuel delivered to the engine it will also be moved angularly by a small amount to vary the timing of delivery of fuel. By this arrangement therefore the timing of fuel delivery can be made to advance as the amount of fuel supplied to the engine is increased.

I claim:

1. A fuel pumping apparatus for supplying fuel to an internal combustion engine comprising a housing, a rotary distributor member mounted in the housing, a transverse bore in the distributor member, a pumping plunger in the bore, a cam ring surrounding the distributor member and defining a plurality of inwardly extending cam lobes which impart inward movements to the plunger as the distributor member rotates, passage means in the distributor member communicating with the bore, said pressure means being arranged to communicate in turn with a plurality of outlets in the housing during successive inward movements of the plunger, means for supplying fuel to the bore to effect outward movement of the plunger in the periods between successive inward movements of the plunger, an axially movable sleeve located about the distributor member, the sleeve and distributor member defining spill path means whereby fuel can be spilled from said bore during the inward movement of the plunger, the relative axial position of the distributor member and sleeve determining the amount of fuel which is supplied through the outlets, governor means for controlling the axial setting of the sleeve within the housing, said distributor member being axially movable within the housing, resilient means biasing the distributor member in one axial direction, means for generating a fluid pressure which varies in accordance with the speed at which the apparatus is driven, a piston movable by said fluid pressure against the action of a spring, a profile defined on said piston and means engaging said profile and said distributor member whereby movement of said piston will result in axial movement of the distributor member and variation of the amount of fuel supplied by the apparatus, wherein the axis of said piston is disposed at right angles to the axis of the distributor member, said profile being formed on an intermediate portion of the piston surface and said means engaging the distributor member and the piston comprising a pin.

2. An apparatus according to claim 1 including means for adjusting the force exerted by said spring and a stop to limit the extent of movement of the piston against the action of the spring.

3. A fuel pumping apparatus for supplying fuel to an internal combustion engine comprising a housing, a rotary distributor member mounted in the housing, a transverse bore in the distributor member, a pumping plunger in the bore, a cam ring surrounding the distributor member and defining a plurality of inwardly extending cam lobes which impart inward movements to the plunger as the distributor member rotates, passage means in the distributor member communicating with the bore, said passage means being arranged to communicate in turn with a plurality of outlets in the housing during successive inward movements of the plunger, means for supplying fuel to the bore to effect outward movement of the plunger in the periods between successive inward movements of the plunger, an axially movable sleeve located about the distributor member the sleeve and distributor member defining spill path means whereby fuel can be spilled from said bore during the inward movement of the plunger, the relative axial position of the distributor member and sleeve determining the amount of fuel which is supplied through the outlets, governor means for controlling the axial setting of the sleeve within the housing, said spill path means including a non-return valve which is set to open at a pressure which is greater than the pressure of fuel supplied to the bore during the outward movement of the plunger but less than the pressure of fuel in the bore during the inward movement of the plunger.

4. An apparatus according to claim 3 in which said sleeve is provided with a pair of slits which are circumferentially spaced and which define between them a wedge shaped land, the slits and a port in the distributor member forming part of said spill path means, said sleeve being housed within a further sleeve which forms a passage extending to the interior of the housing from said slits, said non-return valve being located in said passage.

5. An apparatus according to claim 4 including an arm connected to said further sleeve and means connected to said arm for varying the angular setting of said sleeve about the axis of rotation of the distributor member.

* * * * *